United States Patent [19]

Cavestany

[11] Patent Number: 4,679,545

[45] Date of Patent: Jul. 14, 1987

[54] GAS-FIRED OUTDOOR SPA AND HOT TUB HEATER

[75] Inventor: Adrian V. Cavestany, Moorpark, Calif.

[73] Assignee: Raypak, Inc., Westlake Village, Calif.

[21] Appl. No.: 874,465

[22] Filed: Jun. 16, 1986

Related U.S. Application Data

[63] Continuation-in-part of Ser. No. 778,436, Sep. 20, 1985, abandoned.

[51] Int. Cl.[4] ..... F24H 1/00

[52] U.S. Cl. ..... 126/350 R; 4/493; 126/367; 126/351

[58] Field of Search ..... 126/367, 351, 357, 350 R, 126/348, 312; 4/493, 545; 122/DIG. 10

[56] References Cited

U.S. PATENT DOCUMENTS

| | | | |
|---|---|---|---|
| 3,207,133 | 9/1965 | Andersen | 4/493 X |
| 3,623,458 | 11/1971 | Block | 126/350 R X |
| 3,782,303 | 1/1974 | Pfister et al. | 126/312 X |
| 4,029,451 | 6/1977 | Farnia | 126/350 R X |
| 4,233,694 | 11/1980 | Janosko et al. | 4/493 X |
| 4,390,125 | 6/1983 | Rozzi | 431/19 X |
| 4,501,232 | 2/1985 | Gordbegli et al. | 126/350 R X |

*Primary Examiner*—Randall L. Green

*Attorney, Agent, or Firm*—Evanns & Walsh

[57] ABSTRACT

A heat exchanger unit for use with spas or hot tubs. The unit is constructed to be installed in a side wall of a portable spa or hot tub. The unit has an exposed front plate or panel, and the unit is constructed so as to limit the temperature to which this panel can reach. The heater unit includes a finned tube construction and a blower with a double impeller. Flue gases enter into one end of the blower unit, and fresh air enters this end and also the opposite end so that the flue gases mix with fresh air. The discharge from the blower is through louvers in the front panel. The temperature of the front panel does not rise above a limiting value. The heat exchanger unit is automatically controlled and controls the temperature of the water in the spa or hot tub. A control is provided including a pitot tube positioned in the blower outlet whereby to shut down the system in the event of absence or failure of flow of gases which could allow the temperature to rise above the limiting value.

6 Claims, 4 Drawing Figures

Fig. 1
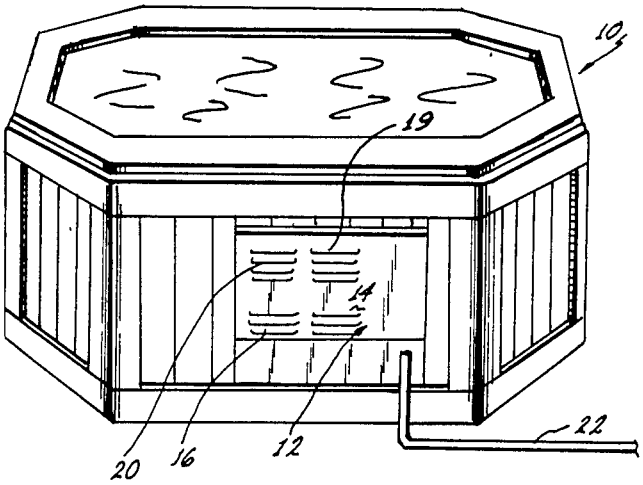
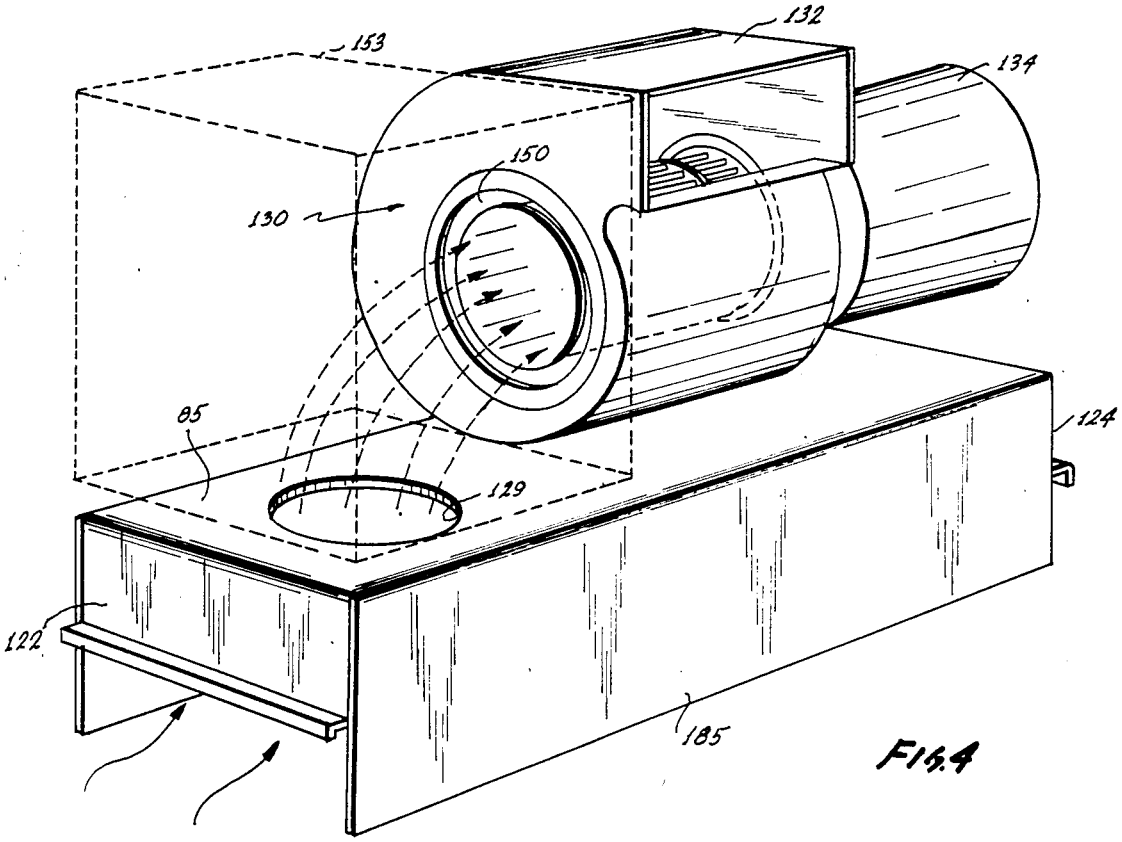
Fig. 4

GAS-FIRED OUTDOOR SPA AND HOT TUB HEATER

This is a continuation-in-part of application Ser. No. 06/788,436, filed on Sep. 20, 1985, abandoned.

BACKGROUND OF THE INVENTION

1. Field of the Invention

The field of the invention is that of gas-fired water heaters and, more particularly, such heaters for use with outdoor spas and hot tubs.

2. Description of the Prior Art

As presently known in the prior art, heating of the water in a spa or tub is provided either by a gas or electric heater. In the case of a gas heater, because of its size and design limitations, it is located remotely from the spa enclosure. An electric heater, although compact enough to be within a spa enclosure, has performance limitations compared to gas and, accordingly, has not been appropriate for use with an outdoor spa, particularly a portable outdoor spa.

With respect to the prior art, as referred to, deficiencies have been present relative to certain other factors, such as the positioning of the heater and the control implications.

The herein invention, a preferred form of which is described in detail, seeks to provide for previously unmet needs, as identified in the foregoing, and to realize other important and unrealized advantages.

SUMMARY OF THE INVENTION

A preferred embodiment of the invention is described hereinafter.

Having reference to outdoor spas or hot tubs, typically they may be portable and made out of wood. It is common for them to be made out of wood. The heater of the herein invention is built into a side wall of the portable spa which, as stated, may be made of redwood. The unit is gas fired and is sufficiently compact to be built into, or mounted in, the side wall of the spa. The unit includes the gas-fired heater, a fire box or equivalent unit, a finned tube heating unit, a flue products collector, chamber or box, and a blower unit.

The blower unit is mounted above the flue collector box. It is a double rotor unit. Gases of combustion enter one end of the blower unit along with fresh air. Fresh or outside air is admitted to the other end of the blower so as to mix with the gases of combustion. The unit is provided with a face plate which is in the form of a panel on the outside which is exposed to the outside of the spa. It is necessary to limit the temperature to which the said face plate reaches to meet safety requirements, and this is achieved by way of the mixing of the gases of combustion with outside air.

A complete electrical control system is provided for the gas-fired heater, with temperature controls, limit controls, air pressure controls, and means to purge the system with outside air before the gas heater is energized.

The controls particularly include a pitot tube which is mounted in the discharge area of the unit so that in the event of failure of flow of discharge gases, the pitot tube would provide an indication and signal which would shut down the system. This is a safety feature whereby in the event that the louvers in the face plate through which the mixed gases and air are discharged should be covered accidentally by way of a towel or otherwise, the system would shut down to prevent overheating.

The details of construction of the representative form of the invention are provided in detail hereinafter.

In light of the foregoing, a primary object of the invention is to realize and provide a spa or hot tub heater unit which is sufficiently compact and which can in fact be built into the side wall of the spa or hot tub.

A further object is to achieve and realize a heater as in the foregoing which is gas fired and which embodies a feature whereby to be able to limit the temperature to which the exposed part or face plate of the heater can be reached, this objective being realized by providing for mixing of gases of combustion and outside air so that the discharged mixture limits the temperature to which the exposed part of the heater can reach.

A further object is to achieve and realize the foregoing objective by way of control means including a pitot tube mounted to be exposed to the mixture of fluids being discharged.

A further object is to realize and provide a face plate or front panel for the heater unit which is electrically isolated from other parts of the heater and particularly by way of a special coating material of polyester/epoxy material of at least five mils in thickness on both sides. In this way, the coated front panel assembly is made electrically non-conductive, enabling it to withstand a 60-cycle potential of up to 2,500 volts. Non-conductive fittings are used for mounting the front panel.

BRIEF DESCRIPTION OF THE DRAWINGS

FIG. 1 is a pictorial view of a spa having the heater unit of the invention built into it;

FIG. 4 is a diagrammatic view of the blower unit and flue box.

DESCRIPTION OF PREFERRED EMBODIMENT AND BEST MODE OF OPERATION

Figure 2:
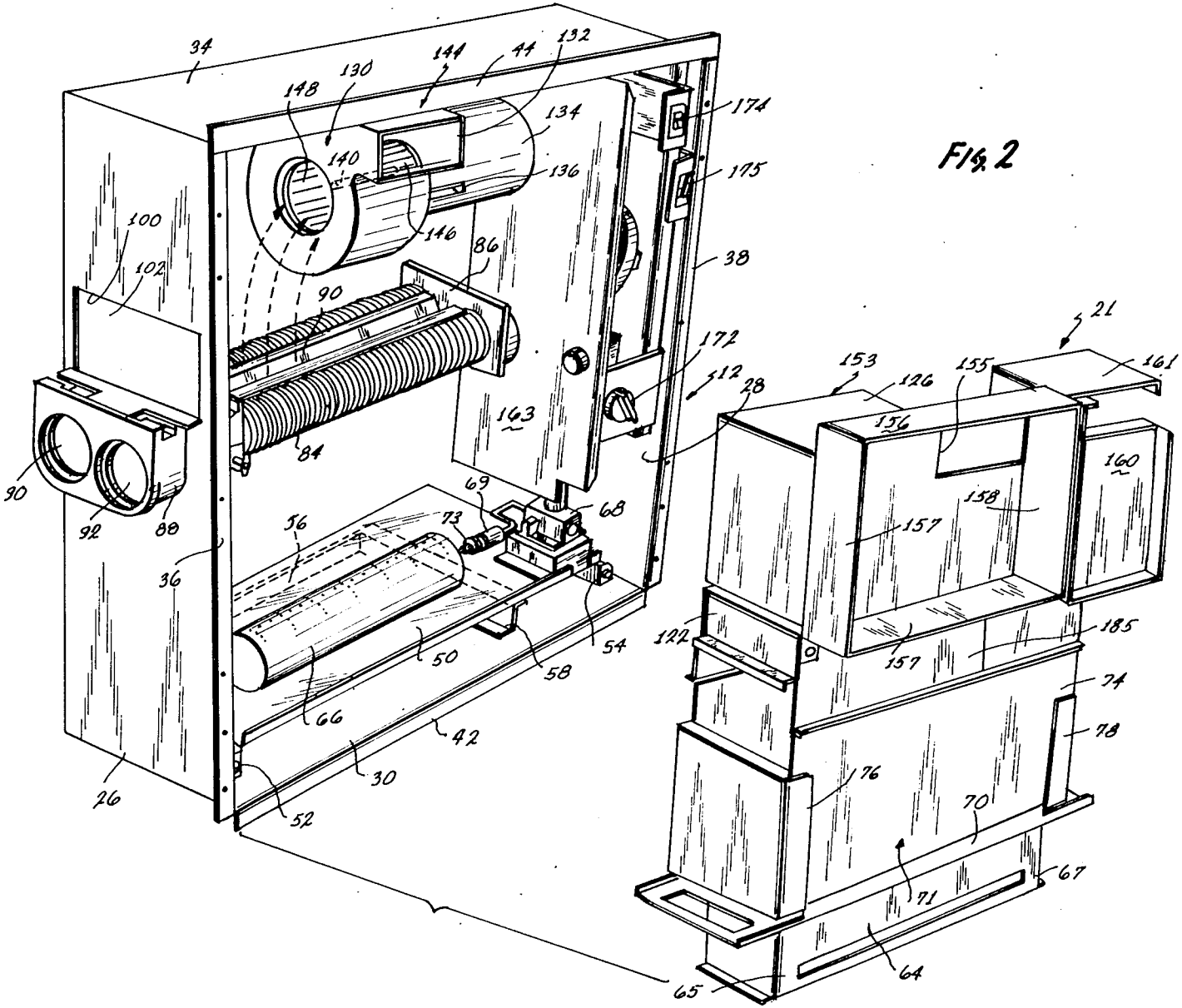
FIG. 2 is an isometric, partly exploded view showing the entire unit and all of its components parts.

Referring to FIG. 1 of the drawings, this figure illustrates a typical spa which is identified by the numeral 10. The shape shown is typical being octagonal and the spa itself may typically be constructed of wood. It is constructed to be portable. The heater unit of the invention which is identified by the numeral 12 is compact in size and is built in to a side wall of the spa 10, as shown. The heater unit 12 has a front panel or face plate 14, as may be seen in FIG. 1. The face plate or panel 14 has louvers positioned at the lower part thereof as identified by the numeral 16 through which combustion air is admitted to the heater unit. The front panel has additional louvers at the upper part thereof, identified by the numeral 20, through which a mixture of flue gases and fresh air is discharged from the unit, as will be described in more detail presently. Numeral 19 designates louvers for admission of outside air. Numeral 22 designates a gas line leading to the burner of the unit.

FIG. 2 shows the interior of the heater unit and the enclosure or cover assembly or unit 21 which fits into the heater casing or housing.

Figure 3:
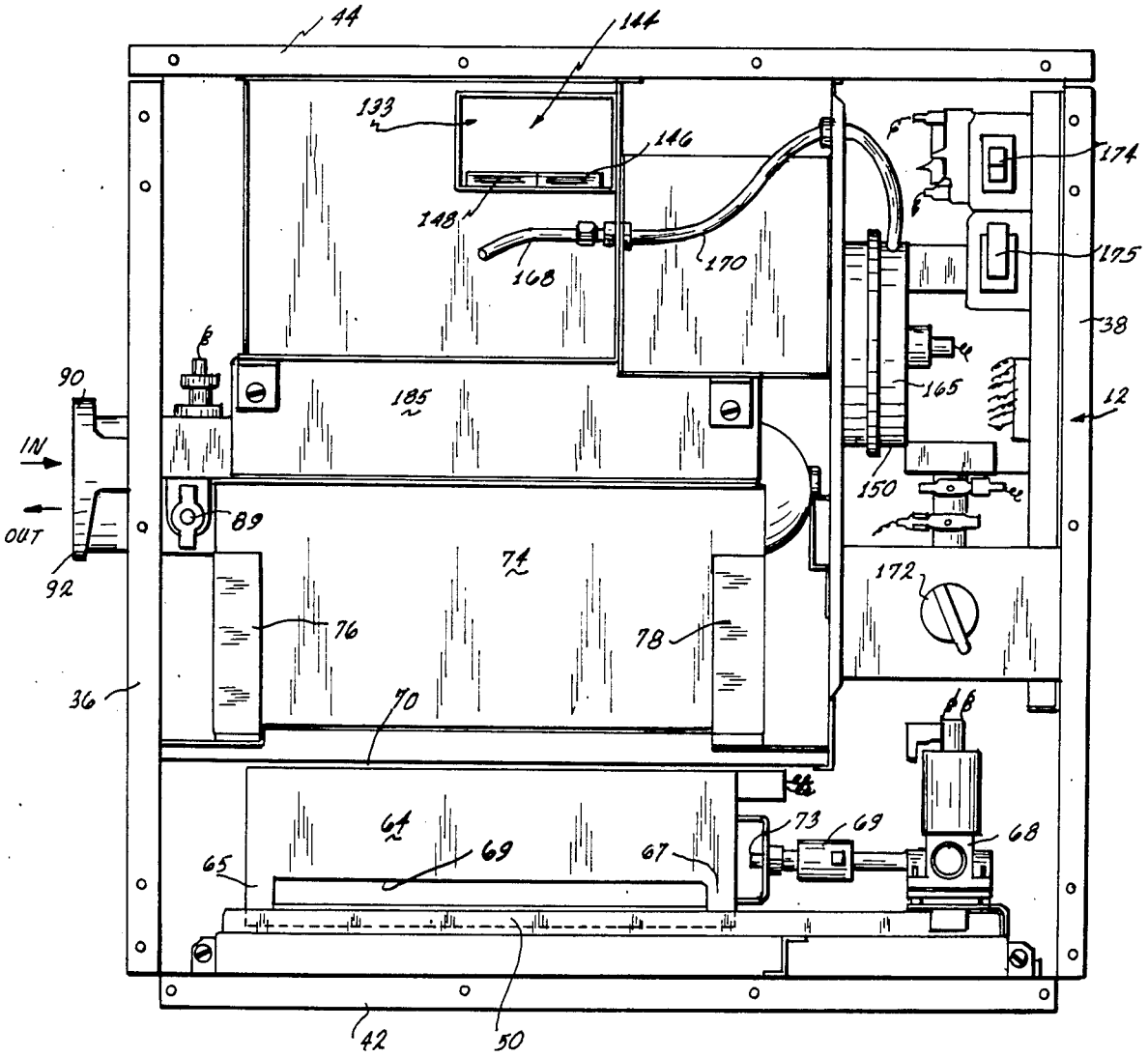
FIG. 3 is a front view of the unit with the piece or the front panel, removed.

Referring now more particularly to FIG. 2, which is an isometric, partly exploded view illustrating the relative positioning of the components of the heater unit, and FIG. 3, which is a front view of the assembled unit with the face plate 14 removed. As previously explained, the unit is relatively compact.

As may be seen in FIG. 2, the unit has side members 26 and 28 and a bottom 30. It has a top member, as designated by the numeral 34. At the front part of the side members are flanges as shown at 36 and 38, and at the front of the bottom 30 is a flange 42. The top member 34 has a flange 44 on its front edge.

The front panel 14 is exposed to the exterior of the enclosure and is subject to possible contact by users. The Underwriter's Laboratories and American National standards require the front panel to be electrically isolated from other parts of the heater. In order to meet these requirements, the front panel 14 is covered by a special coating material (not shown). The front panel is fabricated from sheet metal and it is coated with a material which is polyester/epoxy material no less than 5 mils, (0.005 inch) thick on both sides. This makes the coated front panel assembly electrically non-conductive and able to withstand a 60-cycle potential of up to 2500 volts. The electrical isolation is further assured by way of the use of plastic isolator grommets and nylon shoulder washers (not shown) on all of the screws that are used to secure the front panel assembly 14 to the casing 12.

Numeral 50 designates the burner tray which is of sheet metal construction having end parts 52 and 54, this tray being mounted on the bottom 30 of the casing of the unit. The bottom of the casing as shown at 30 has upright flange members as shown at 56 and 58 and the tray 50 and its parts fit over the bottom 30 of the casing. Carried on tray 50 is a rectilinear housing 64 having sides and ends made of sheet metal within which the burner 66 is mounted. It has feet 65 and 67 and combustion air admission slot 69. The burner unit 66 itself may be a gas burner of typical construction mounted within the housing 64. Associated with the gas burner is a solenoid-operated gas valve 68 and manifold 69 and nozzle 73 along with controls as already known in the art, including gas ignitor and the necessary safety controls.

Positioned above the burner 66 within the casing of the unit is a platform 70 supporting a sheet structure having sides members one of which is shown at 74 within end frames 76 and 78 forming a housing. Preferably situated within this housing is a unit forming an enclosure constructed of high-temperature resistant refractory material which in effect forms a liner which is above the burner 66. The relative positions of the housing for the burner, the burner itself and the burner support tray 50 can be observed from FIG. 2 and also FIG. 3.

Situated within the casing of the unit 12 is a finned tube heat exchanger 84. It is preferably constructed in the form of parallel finned tubes having a frame or fitting 86 at one end and a manifold 88 at the other end, having openings 90 and 92 as shown in FIG. 2 to have an inlet water pipe connected and exhaust water pipe connected thereto. The water from within the spa is carried through the finned tubes to be heated and the exhaust from them, back into the spa. The heat exchanger has a position relative to the burner unit as may be seen in FIG. 2, the wall 26 of the heater unit housing having an opening 100 in it which may be covered by a removable plate 102. The manifold 88 has wells in its top surface as shown to accommodate a thermostatic element. Numeral 89 shows a drain plug for the manifold 88. Numeral 90 designates a baffle member between the finned tubes.

Situated above the finned tube heat exchanger 84 and the refractory enclosure is the flue product collector box 185. This is in the form of a rectilinear sheet metal structure having an end wall 124 and an end wall 122 and a top wall 85. See FIG. 2 and FIG. 4.

As may be seen in FIG. 4, the top of the flue collector box 185 has a circular opening 129. The flue gases can be drawn out of this opening into the entrance to the blower unit as will be described. See FIG. 4.

The blower unit is designated by the numeral 130. It is in the form of a housing having an upper discharge part 132. The blower is driven by a motor as designated by the numeral 134, which is attached to the blower housing 130 by way of brackets, one of which is designated at 136. On the shaft of the motor within the blower unit is the blower impeller wheel as designated by the numeral 144. The blower impeller wheel 144 is of dual construction, having a right-hand part 146 and a left-hand part 148, as will be described. Reference should be made to FIG. 4 which shows the opening 150 in the end of the blower housing 130 for the admission of fresh air along with the flue gases. Numeral 153 designates an enclosure which covers the hole 129 and the end of the blower housing 130 and the opening 150. The arrows show how the flue gases are drawn from the hole 129 into the opening in the end of the blower housing 130. The bottom of enclosure 153 is spaced from the top of flue product collector box 185 as shown so that fresh air can enter into the enclosure 153 in between its bottom edges and the top of the flue box 185. Thus, a mixture of flue gases and air enters into the left-hand of the blower housing 130 so as to mix therein the fresh air that enters into the right end of the blower housing, and this mixture of flue gases and fresh air is discharged through the blower outlet 132, opening 133 and then through the upper louvers 20 in the face plate or panel 14 of the unit.

When the assembly or unit 21 is in place in the casing 12, the enclosure 153 comes into a position relative to the blower 130 as may be seen in FIG. 4. Numeral 155 designates a rectangular opening as shown in FIG. 2 which is in the corner of a discharge space which is behind the louvers 20. This space has a top 156, sides 157 and 158 and a bottom 159. Numeral 160 designates a panel which is in front of the motor 134, and numeral 161 designates a plate that is over the motor 134 and flush with the inside of the casing of the unit 12. The opening above panel 160 comes into position near motor 134 and behind air entrance louvers 19. The assembly or unit 21 fits into the casing of the unit 12 in between the left-hand side wall and the upright panel 163. The controls are situated in between the panel 163 and the right-hand side wall of the cabinet 12.

From the foregoing, it will be readily understood how the combustion air enters into through face plate and into the combustion chamber and how the combustion gases pass over the finned tubes for heating the water and then are drawn into the blower housing. It will also be understood how fresh air enters the unit and into the blower housing to mix with the gases of combustion and to mix these mixtures and discharge them through the upper louvers 20 of the face plate of the unit. In this manner, the temperature of the face plate is held within a predetermined lower limit to comply with safety requirements.

The unit is automatically controlled, provided with certain manual adjustments. Preferably, the unit is controlled by an electronic control component of known commercial type which provides the starting sequence for the unit, that is, it provides for opening of the gas valve that supplies gas to the unit; the ignition of the gas and the starting of the blower motor. The control component provides a desired sequence of operations, that is, with respect to the opening of the valve, the ignition of the gas and the starting of the blower unit, the sequence being such as to purge any gases within the unit before the gas is admitted and ignited.

A particular feature of the control system is that control is provided to shut down the unit in the event of failure or lack of flow of the mixture of gases from the louvers as shown at 20. This might occur as a result, for example, of a towel being left draped over the face plate which could give rise to danger. This control feature includes a pressure-responsive control switch that is designated by the numeral 165 which is responsive to a control instrumentality which is a pitot tube 168 which may be seen in FIG. 3 that is mounted at the outlet 132 of the blower 130. The orifice of the pitot tube is pointed in an outward direction so that in the event of failure of flow, a change in pressure is sensed which actuates the pressure switch 165 to shut down the system. The pitot tube 168 is connected to the pressure switch 165 by a tube 170.

The unit may be supplied with power from a 115 volt 60 cycle supply by way of example. In addition to the control mentioned above, the unit primarily is controlled by way of a thermostat located in the spa or tub so as to maintain a desired temperature in the tub. Numeral 172 designates a control knob which is adjustable to maintain desired temperatures, the knob adjusting a controller associated with the temperature responsive element which is located within the tub or spa.

Numeral 174 designates a manual on-off switch for the unit. Numeral 175 designates a switch operating member which closes the switch for energizing the system when the face plate or panel is mounted on the unit by being attached to the flanges 36, 38, 42 and 44. The face plate is electrically isolated from the remainder of the unit, as already described.

From the foregoing, those skilled in the art will readily understand the nature and construction of the invention and the manner in which it realizes all of the objectives as set forth in the foregoing. The foregoing disclosure is representative of a preferred form of the invention and it is to be interpreted in an illustrative rather than a limiting sense, the invention to be accorded the full scope of the claims appended hereto.

What is claimed is:

1. A portable spa unit having peripheral walls and adapted for outdoor use containing heated water, the said spa unit having one side wall adapted to receive a heater, the said heater having a panel exposed to the outside of the spa unit and positioned substantially flush with the outside wall of the spa, a self-contained, gas fired water heater constructed to be contained within said one side wall of the spa unit, the heater having connections to the interior of the spa unit for the water to be passed through the heater to be heated, the heater including a gas burner and means including connections for supplying gas to the burner, the panel having openings for the admission of combustion air from outside the spa unit and having openings for the discharge of gases of combustion to outside of the spa unit, and circulating means for circulating combustion gases from the burner and discharging the said gases from the heater through said discharge openings in said panel, and said circulating means having means for limiting the temperature of the gases being discharged whereby to limit the temperature of said exposed panel of the heater unit.

2. An article as in claim 1, wherein said temperature limiting means comprises means for admitting outside air to the said circulating means for mixing the said outside air with combustion gases being discharged from the unit.

3. An article as in claim 2, said circulating means comprises a motor driven blower means within the heater unit constructed for circulating both the combustion gases and the outside air and for mixing the said gases and air for controlling the temperature of the discharged gases.

4. A spa unit adapted for outdoor use containing heated water, the said spa unit having a side wall adapted to receive a heater, an outside panel to be located in said side wall and having openings for combustion air and openings for the discharge of combustion gases a self-contained, gas-fired water heater constructed to be contained within said side wall of the spa unit, the heater having connections to the interior of the spa unit for the water to be passed through the heater to be heated, the heater including a gas burner and means including connections for supplying gas to the burner, circulating means for circulating combustion gases from the burner and discharging the said gases from the heater, through the discharge openings in said panel means associated with the circulating means for limiting the temperature of the gases being discharged whereby to limit the temperature of said panel including means for admitting outside air to the said circulating means and for mixing the said air with combustion gases being discharged from the unit, said circulating means including motor driven blower means and a circulating element within the heater constructed for circulating both the combustion gases and the outside air, the blower means further comprises a housing having an opening at one end for receiving combustion gases and having an opening at the other end for receiving outside air and having a discharge channel through which combustion gases and outside air are discharged.

5. An article as in claim 4, including an instrument responsive to predetermined discharge pressure of combustion gases from said discharge panel for shutting down the heater unit.

6. An article as in claim 5 wherein said instrument is in the form of a pitot tube positioned to sense change of pressure in the combustion gases being discharged.

* * * * *